United States Patent [19]

Haeck et al.

[11] Patent Number: 4,641,866

[45] Date of Patent: Feb. 10, 1987

[54] LEVER HANDLE DOOR TRIM

[75] Inventors: Paul J. Haeck; Gary R. Jacobs, both of Indianapolis, Ind.

[73] Assignee: Von Duprin, Inc., Indianapolis, Ind.

[21] Appl. No.: 797,114

[22] Filed: Nov. 12, 1985

[51] Int. Cl.[4] ..... E05B 3/00

[52] U.S. Cl. ..... 292/336.3; 16/112; 74/54; 74/545; 74/567; 292/347; 292/DIG. 60

[58] Field of Search ..... 292/336.3, DIG. 60, 292/347, 350, 336.5; 70/209; 16/112, 123, 126, 127

[56] References Cited

U.S. PATENT DOCUMENTS

| | | | |
|---|---|---|---|
| 2,899,228 | 8/1959 | Polchinski et al. | 292/336.3 |
| 2,937,897 | 5/1960 | Soderberg | 292/1 |
| 3,026,136 | 3/1962 | Russell et al. | 292/336.3 |

FOREIGN PATENT DOCUMENTS

| | | | |
|---|---|---|---|
| 2259966 | 8/1975 | France | 292/336.3 |

*Primary Examiner*—Robert L. Wolfe
*Assistant Examiner*—Lloyd A. Gall
*Attorney, Agent, or Firm*—B. J. Murphy

[57] ABSTRACT

The invention comprises a lever handle having a handle-shaft receiving cam which is used to displace a slider to effect the retraction of a latchbolt. A yoke is positioned between the cam and slider to accommodate, adjustably, for handle droop. The yoke has a tapped hole and receives a machine screw which also penetrates an arcuate slot in the slider. Displacement of the yoke relative to the slot, corrects the handle droop by causing the cam to be slightly tilted. Accordingly, the handle shaft in the cam is correspondingly rotated about its axis, and the handle is brought into alignment with the horizontal.

6 Claims, 5 Drawing Figures

FIG. 1
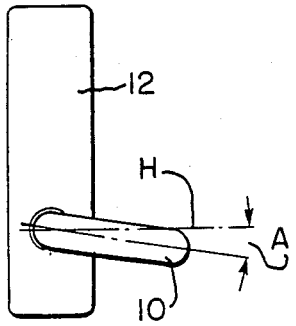
FIG. 2
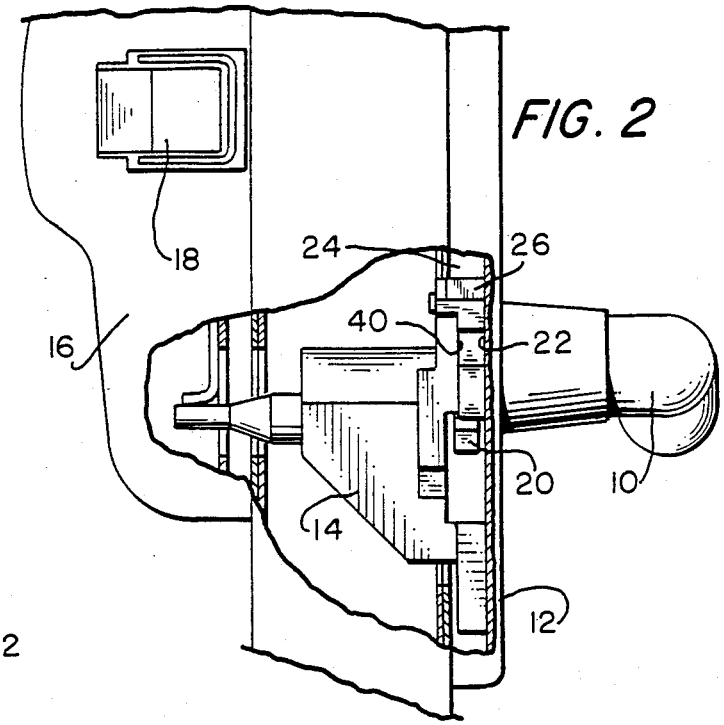
FIG. 4A
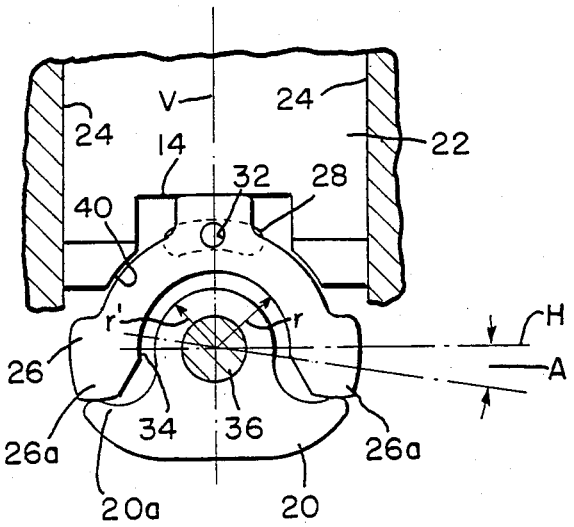
FIG. 4B
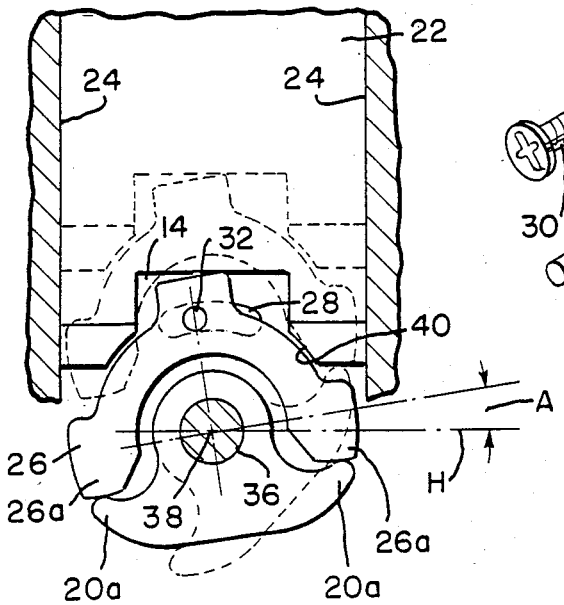
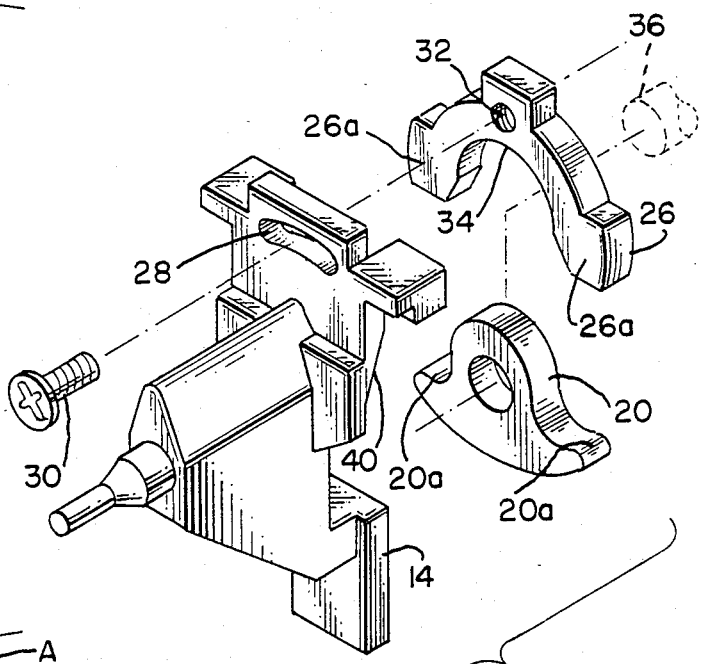
FIG. 3

LEVER HANDLE DOOR TRIM

This invention pertains to door trim, and in particular it pertains to door trim for lever handles providing for adjustment thereof to cure handle droop.

On lever handle door trim, a condition sometimes exists in which the centerline of the handle rests in a position which is tilted from, or misaligned with, the horizontal. This condition, called handle droop, is undesirable because it detracts from the appearance of a door trim installation. The preferred handle position is slightly angled above the horizontal.

Handle droop occurs because of the stack-up i.e., the summation, of manufacturing tolerances built into, and/or the wear of, the internal parts from which the door trim is assembled.

Prior art door trim for lever handles have no means for correcting handle droop. Such trim commonly incorporates a cam, having a fixed geometry, secured on the shaft of the lever handle, and the cam translates a slider (which, in turn, engages and actuates a door latch mechanism to retract a latchbolt). Nothing in the chain of assembly, from the handle shaft to the latch mechanism, is adjustable to correct for handle droop.

It is an object of this invention, therefore, to set forth a lever handle door trim having means for correcting any handle droop thereof, arising from manufacture, or occurring from wear of component parts.

It is particularly an object of this invention to set forth lever handle door trim comprising a slider, movable along a vertical axis for operating an exit device, mortise lock, or a like latching mechanism for a latchbolt, to cause retraction of said latchbolt; a cam, for effecting movement of said slider; said cam having a body portion with an opening formed therein in which to receive a lever handle shaft; said opening having a radial center defining a rotary axis for such a lever handle shaft; said cam further having a pair of lobes extending outwardly from opposite sides of said body portion along a horizontal plane; and means interposed between, and engaging both, said slider and said cam, and adjustable for causing said cam to be selectively displaced through an acute angle, relative to said rotary axis, to dispose said cam at a tilt relative to said horizontal plane.

Further objects of this invention, as well as the novel features thereof, will become more apparent by reference to the following description taken in conjunction with the accompanying figures, in which:

FIG. 1 is a front elevational view of a lever handle door trim illustrative of the handle droop condition;

FIG. 2 is a depiction of a portion of a door, partly cut away to show how the novel trim of the invention, in an embodiment thereof, cooperates with an exit device to retract a latchbolt;

FIG. 3 is an isometric exploded view of the invention, according to the FIG. 2 embodiment thereof;

FIG. 4A depicts only a portion of the slider with the yoke and cam coupled thereto, the shaft of the lever handle being shown in cross-section, with the handle droop condition obtaining therefrom; and FIG. 4B is a view like that of FIG. 4A showing in full line illustration the adjusted correction for the handle droop, and in broken-line illustration the cam-induced vertical translation of the slider.

As shown in the figures, the lever handle 10 of a latching mechanism is shown mounted to a face plate 12, and is depicted to show the handle 10 drooped, or out of alignment with the horizontal, "H", through an angle "A". As noted, this condition arises because of the summing of manufacturing tolerances of the several components and/or is due to wear of the assembled parts.

The handle 10 is used to cause translation of a slider 14 along a vertical axis "V", and the slider is in contacting and operative engagement with an exit device 16. Upon vertical movement of the slider 14, along the axis "V", the exit device 16 retracts the latchbolt 18.

In the prior art, it has been the practice for a dual-lobed cam 20 to engage the slider 14 upon rotation of the cam in either a clockwise or counterclockwise direction. As a consequence, the slider 14 travels vertically, through a trackway 22 within parallel walls 24 thereof, along the axis V, to operate the exit device 16. The slider 14 and cam 20 had a fixed normal correlation in which neither was adjustable relative to the other. Therefore, if the handle 10 drooped, due to part wear, or the like, it was not correctable.

According to the invention, a generally U-shaped, yoke-type element 26 is interposed between the slider 14 and the cam 20. Element or yoke 26, U-shaped, has a pair of abutments **26*a* formed on opposite ends thereof for contacting engagement thereof with the lobes 20*a* of the cam 20. In addition, the head of the slider 14 has an arcuate slot 28 to receive a machine screw 30 which fastens into a tapped hole 32 in the yoke 26. When and if there should occur handle droop, it is necessary only to loosen the machine screw 30, rotate the yoke 26 through a small angle to bring the lever handle 10 into alignment with the horizontal, "H", and coincidentally to tilt the cam 20** slightly, and then tighten the screw.

As illustrated, the yoke 26 has an arcuate cove 34 defined by a radius "r" drawn from the radial center of the handle shaft 36, and the cam 20 has an arcuate surface drawn on another radius "r'" from the radial center or the rotary axis 38 of the shaft 36. The arcuate surface of the cam 20 is nested within the cove 34 of the yoke 26 and the two are received within a recess 40 in a surface of the slider 14.

By comparing FIGS. 4A and 4B, the adjusted correction can be readily seen. In FIG. 4A, the cam 20, yoke 26 and slider 14 have a normal, as manufactured and assembled, relationship. Even so, assuming manufacturing tolerances, or part wear, the handle 10, let us say, has a droop of angle "A". Now then, it is only necessary to dispose the yoke 26 at a slight counterclockwise angle (equal to angle "A"), by means of screw 30, slot 28, and hole 32, to cause the cam 20 to be tilted correspondingly as shown in FIG. 4B. Hence the handle shaft 36 is rotated, for being made fast with the cam 20 (by means not shown), to a correction where the handle aligns with the horizontal, "H".

While we have described our invention in connection with a specific embodiment thereof, it is to be clearly understood that this is done only by way of example and not as a limitation to the scope of our invention as set forth in the objects thereof and in the appended claims.

We claim:

1. Lever handle door trim, comprising:

a slider, movable along a vertical axis for operating an exit device latching mechanism for a latchbolt, to cause retraction of said latchbolt;

a cam, for effecting movement of said slider;

said cam having a body portion with an opening formed therein in which to receive a lever handle shaft;

said opening having a radial center defining a rotary axis for such a lever handle shaft;

said cam further having a pair of lobes extending outwardly from opposite sides of said body portion along a horizontal plane; and means interposed between, and engaging both, said slider and said cam, and adjustable for causing said cam to be selectively displaced through an acute angle, relative to said rotary axis, to dispose said cam at a tilt relative to said horizontal plane.

2. Lever handle door trim, comprising:

a slider, movable along a vertical axis for operating an exit device latching mechanism for a latchbolt, to cause retraction of said latchbolt;

a cam, for effecting movement of said slider;

said cam having a body portion with an opening formed therein in which to receive a lever handle shaft;

said opening having a radial center defining a rotary axis for such a lever handle shaft;

said cam further having a pair of lobes extending outwardly from opposite sides of said body portion along a horizontal plane; and means interposed between, and engaging both, said slider and said cam, and adjustable for causing said cam to be selectively displaced through an acute angle, relative to said rotary axis, to dispose said cam at a tilt relative to said horizontal plane; wherein said means comprises a generally U-shaped, yoke-type element;

said element has a pair of abutments, formed on opposite ends thereof, in contacting engagement with said lobes;

said element is removably fastened to said slider for vertical travel coincident with said slider;

said element has a tapped hole formed therein;

said slider has an arcuate slot formed therein; and a headed fastener is threadedly engaged with said tapped hole, and has its shank in penetration of said slot.

3. Lever handle door trim, comprising:

a slider, movable along a vertical axis for operating an exit device latching mechanism for a latchbolt, to cause retraction of said latchbolt;

a cam, for effecting movement of said slider;

said cam having a body portion with an opening formed therein in which to receive a lever handle shaft;

said opening having a radial center defining a rotary axis for such a lever handle shaft;

said cam further having a pair of lobes extending outwardly from opposite sides of said body portion along a horizontal plane; and means interposed between, and engaging both, said said slider and said cam, and adjustable for causing said cam to be selectively displaced through an acute angle, relative to said rotary axis, to dispose said cam at a tilt relative to said horizontal plane; wherein said means comprises a generally U-shaped, yoke-type element;

said element has a pair of abutments, formed on opposite ends thereof, in contacting engagement with said lobes; and said element is removably fastened to said slider for vertical travel coincident with said slider.

4. Lever handle door trim, according to claim 3, wherein: said element has an arcuate cove formed therein, and drawn on a given radius from said rotary axis.

5. Lever handle door trim, according to claim 4, wherein: said body portion of said cam has an arcuate surface formed thereon, and drawn on another radius from said rotary axis.

6. Lever handle door trim, according to claim 5, wherein: said arcuate surface of said body portion is nested within said cove of said element.

* * * * *